United States Patent [19]

Geyer et al.

[11] Patent Number: 4,840,367

[45] Date of Patent: Jun. 20, 1989

[54] CASSETTE WITH A TAPE BOX FOR TAPE DISPENSERS OF MAIL PROCESSING MACHINES

[75] Inventors: Oswald Geyer, Altenstadt; Helmut Lembens, Wiesbaden-Naurod; Helmut Stoyhe, Obertshausen, all of Fed. Rep. of Germany

[73] Assignee: Francotyp-Postalia GmbH, Berlin, Fed. Rep. of Germany

[21] Appl. No.: 120,875

[22] Filed: Nov. 16, 1987

[30] Foreign Application Priority Data

Nov. 14, 1986 [DE] Fed. Rep. of Germany ... 8630748[U]

[51] Int. Cl.[4] ..... B65H 1/12

[52] U.S. Cl. ..... 271/160; 221/279; 312/61

[58] Field of Search ..... 271/147, 148, 157, 160, 271/169; 221/198, 279, 280, 45, 56–60, 62, 46, 49, 52; 312/61

[56] References Cited

U.S. PATENT DOCUMENTS

| | | | |
|---|---|---|---|
| 1,198,428 | 9/1916 | Elsas | 221/59 |
| 1,682,580 | 8/1928 | Pratt | 312/61 |
| 1,707,578 | 4/1929 | Shaffer | 221/62 |
| 1,895,661 | 1/1933 | Horwitt | 221/59 |
| 1,901,243 | 3/1933 | Horwitt | 221/279 |
| 2,027,671 | 1/1936 | Broeren | 221/59 |
| 2,034,516 | 3/1936 | Hunt et al. | 221/198 |
| 3,343,716 | 9/1967 | Peebles | 221/46 |
| 4,585,145 | 4/1986 | Pitroda | 221/58 |

FOREIGN PATENT DOCUMENTS

| | | | |
|---|---|---|---|
| 2253784 | 5/1973 | Fed. Rep. of Germany | 221/279 |

*Primary Examiner*—H. Grant Skaggs

*Attorney, Agent, or Firm*—Herbert L. Lerner; Laurence A. Greenberg

[57] ABSTRACT

A cassette for tape dispensers of mail processing machines includes a housing having a dispenser opening formed therein. Stop beads are formed on the housing at the dispenser opening. A tape box is disposed in the housing for receiving tapes. A bearing plate is disposed in the tape box. A magazine spring presses the bearing plate against tapes in the tape box and presses the tapes against the stop beads. A parallel guidance device having upper and lower scissors members and connecting rods guides the bearing plate parallel to the dispenser opening.

9 Claims, 2 Drawing Sheets

CASSETTE WITH A TAPE BOX FOR TAPE DISPENSERS OF MAIL PROCESSING MACHINES

Figure 1:
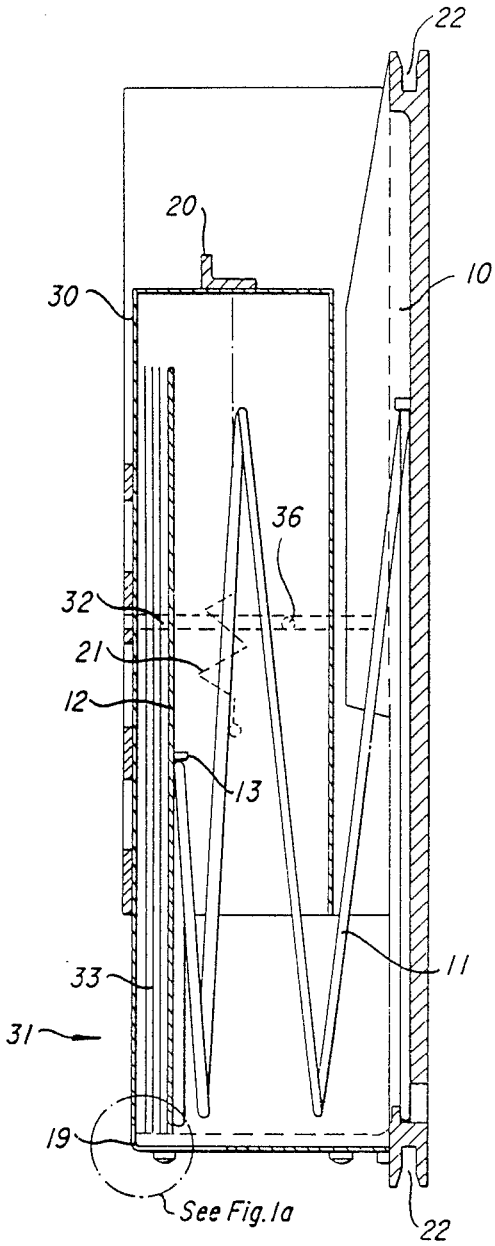

The invention relates to a cassette having a tape box for tape dispensers of mail processing machines.

In the field of mail processing, tape dispensers in postage meters are preferably used for applying postage to mail, such as packages. Strips of paper are unwound automatically, such as from paper rolls, they are cut, provided with imprinted postage and opertionally moistened along a mail handling line, and they are applied to the article to be mailed.

Relatively high mechanical effort is required in order to unwind the tapes from rolls and to cut them, because the paper roll must be braked during high-speed passage through the apparatus, in order to prevent it from unwinding on its own. In this connection, the tearing strength of the material of which the tape is formed must also meet certain demands, as must the cutting device. For these reasons, the use of individual, pre-cut tapes is preferred.

It is accordingly an object of the invention to provide a refillable cassette with a tape box for tape dispensers of mail processing machines, which overcomes the hereinaftementioned disadvantages of the heretofore-known devices of this general type and which can be used in a simple fashion as a tape dispenser in postage meters.

With the foregoing and other objects in view there is provided, in accordance with the invention, a cassette for tape dispensers of mail processing machines, comprising a housing having a dispenser opening formed therein, stop beads formed on the housing at the dispenser opening, a tape box disposed in the housing for receiving tapes, a bearing plate disposed in the tape box, a magazine spring pressing the bearing plate against tapes in the tape box and pressing the tapes against the stop beads, and a parallel guidance device having upper and lower scissors members and connecting rods guiding the bearing plate parallel to the dispenser opening.

In accordance with another feature of the invention, the housing has ribs, the bearing plate has bearing eyes, the lower scissors members are secured to the ribs, and there are provided bearing bolts securing the upper scissors members in the bearing eyes.

In accordance with a further feature of the invention, the housing has grooves formed therein for linear guidance of the bearing plate in the vertical direction.

In accordance with an added feature of the invention, the bearing bolts provide linear guidance.

In accordance with an additional feature of the invention, the bearing plate has additional round bolts providing linear guidance.

In accordance with yet another feature of the invention, the tape box has an end oriented toward the dispenser opening having an arcuate opening formed therein.

In accordance with yet a further feature of the invention, there is provided a a bracket disposed on the housing, and tension springs attached to the bracket for fixing the tape box in position with respect to the housing.

In accordance with yet an added feature of the invention, the housing has lateral guide grooves formed therein.

In accordance with yet an additional feature of the invention, the housing is formed of plastic.

In accordance with a concomitant feature of the invention, the tape box is formed of cardboard.

Other features which are considered as characteristic for the invention are set forth in the appended claims.

Although the invention is illustrated and described herein as embodies in a cassette with a tape box for tape dispensers of mail processing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1A:
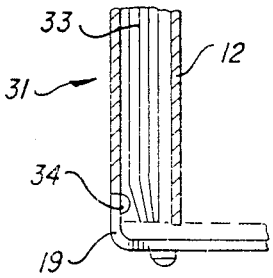
Figure 2A:
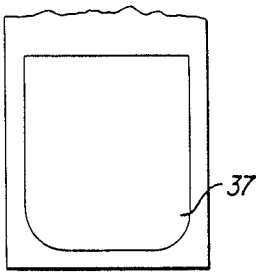
Figure 2:
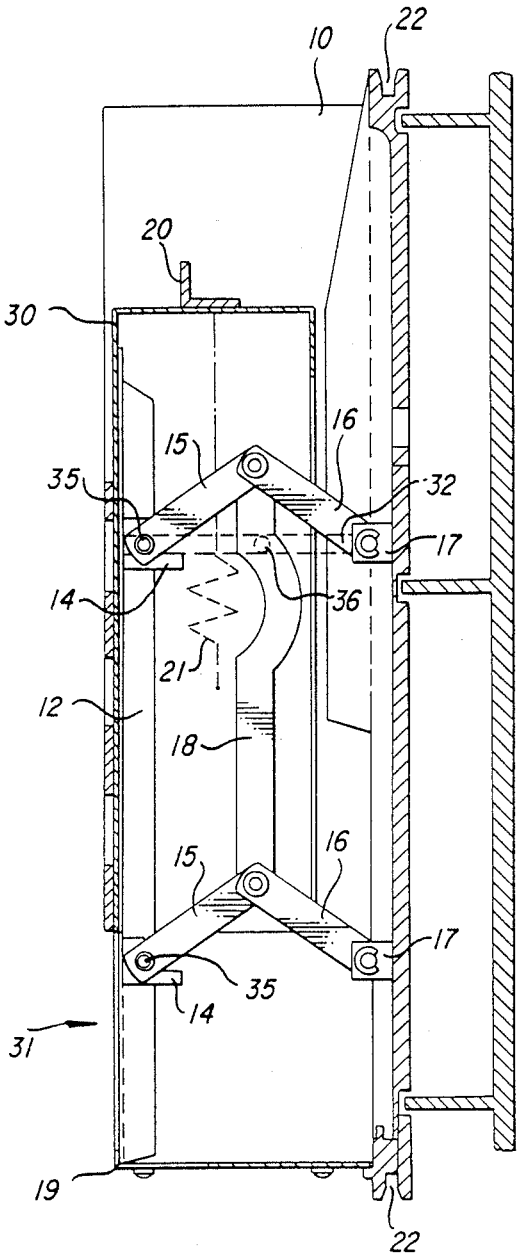

FIG. 1 is a longitudinal-sectional view of a cassette with a tape box disposed therein;

FIG. 1*a* is an enlarged fragmentary view of FIG. 1,

FIG. 2 is a view similar to FIG. 1, including additional adjusting means for the cassette and feed means for the tapes; and FIG. 2*a* is a fragmentary view of FIG. 2 as seen from the left-hand side of the cassette.

Referring now in detail to the figures of the drawings in which identical elements are identified by the same reference numerals and first, particularly, to FIG. 1 thereof, there is seen a cassette 10 having a housing which serves to receive a tape box 30. The tap box 30 is filled with a number of individual tapes 33 which protrude out of the box or are freely accessible in some other form at one end, preferably through an arcuate opening 37 (FIG. 2*a*) formed in the tape box 30. When the tape box 30 is inserted into the cassette 10, a stop serves to limit the travel of the tape box, which assures that the individual tapes 33 are seating with play as they are pulled out by means of an unwinding roll at a dispenser opening 31 in the housing of the cassette 10.

The cassette 10 has a magazine spring 11, which acts upon a bearing plate 12. The lower end of the magazine spring 11 is secured to the bottom of the cassette 10 by means of a force-locking connection. A force-locking connection is one which connects two elements together by force external to the elements, as opposed to a form-locking connection which is provided by the shapes of the elements themselves. The free upper end of the magazine spring 11 is fixed by means of the bearing plate 12 which has two bent-over opposite sides and by means of a protrusion 13 of the bearing plate 12. As seen in FIG. 2, each of the opposite bent-over sides of the bearing plate 12 are equipped with two open bearing eyes 14, which serve to receive bearing bolts 35 of four upper scissors members 15 of a parallel guidance device. Four lower scissors members 16 of the parallel guidance device are rotatably secured on ribs 17 of the housing of the cassette 10. The upper and lower scissors members 15, 16 are each joined together by a respective connection rod 18, which assures parallel guidance by means of intermediate rods.

The side walls of the cassette 10 are also provided with grooves 32. The bent-over sides of the bearing plate 12 are oriented toward the grooves, and round bolts 36 slide in the grooves on each side. This structure prevents deflection of the bearing plate 12 toward the closed end of the tape box 30. Instead of an additional round bolt 36, the bearing bolts 35 of the upper scissors members 15 can also be used for the linear guidance of the bearing plate 12 in the vertical direction, given suitable shaping.

When a tape box 30 is inserted, the bearing plate 12 presses from below against the stack of tapes in the arcuate opening 37 in the box and presses the tapes 33 against upper stop beads 34 (FIG. 1*a*) of the cassette 10 at the dispenser opening 31. After the last strip of tape has been removed, the edge of the surface of the bearing plate 12 rests below two protrusions 19 of the face plate of the cassette 10.

A pivotable bracket 20 also provides for the continuous pressing of the tape box 30 against stop edges in the cassette 10. The bracket 20 is pressed against the tape box 30 by means of tension springs 21. The tension springs 21 are secured to the lateral inner or outer walls of the cassette 10. When a tape box is changed, the bracket 20 is pivoted through 90° with respect to the bottom of the cassette 10.

The bottom of the cassette 10 is equipped with lateral guide grooves 22, so that the cassette 10 can be used on guides in the housing chassis of mail processing machines. Other ribs of the housing chassis can be provided for supporting the cassette 10, as indicated in FIG. 2.

The cassette 10 is preferably manufactured from plastic, while the tape box is produced from plastic or cardboard.

We claim:

1. Cassette for tape dispensers of mail processing machines, comprising a housing having a dispenser opening formed therein, stop beads formed on said housing at said dispenser opening, a tape box disposed in said housing for receiving tapes, a bearing plate disposed in said tape box, a magazine spring pressing said bearing plate against tapes in said tape box and pressing the tapes against said stop beads, and a parallel guidance device guiding said bearing plate parallel to said dispenser opening, said parallel guidance device including upper pivotally connected scissors members and lower pivotally connected scissors members, and a connecting rod connected between said upper scissors members and said lower scissors members.

2. Cassette according to claim 1, wherein said housing has ribs, said bearing plate has bearing eyes, said lower scissors members are secured to said ribs, and including bearing bolts securing said upper scissors members in said bearing eyes.

3. Cassette according to claim 2, wherein said bearing bolts provide linear guidance.

4. Cassette according to claim 1, wherein said housing has a groove formed therein for linear guidance of said bearing plate in the vertical direction, and said connecting rod has a bolt engaged in said groove.

5. Cassette according to claim 1, wherein said tape box has an end oriented toward said dispenser opening having an arcuate opening formed therein.

6. Cassette according to claim 5, wherein said tape box is formed of cardboard.

7. Cassette according to claim 1, including a bracket disposed on said housing, and tension springs attached to said bracket for fixing said tape box in position with respect to said housing.

8. Cassette according to claim 1, wherein said housing has lateral guide grooves formed therein.

9. Cassette according to claim 1, wherein said housing is formed of plastic.

* * * * *